US005839029A

United States Patent [19]

Kataoka et al.

[11] Patent Number: 5,839,029

[45] Date of Patent: Nov. 17, 1998

[54] CHARGING DEVICE

[75] Inventors: Hiroyuki Kataoka; Eiko Tanaka; Hiroshi Takayama, all of Ebina, Japan

[73] Assignee: Fuji Xerox Co., Ltd., Tokyo, Japan

[21] Appl. No.: 802,106

[22] Filed: Feb. 19, 1997

[30] Foreign Application Priority Data

Feb. 21, 1996 [JP] Japan ..... 8-033223

[51] Int. Cl.[6] ..... G03G 21/18

[52] U.S. Cl. ..... 399/115; 399/168; 399/174; 399/176; 430/902

[58] Field of Search ..... 399/115, 168, 399/174, 176; 430/56, 66, 67, 68, 69

[56] References Cited

U.S. PATENT DOCUMENTS 4,939,056 7/1990 Hotomi et al. ..... 430/66

5,430,526 7/1995 Ohkubo et al. ..... 399/174 X

FOREIGN PATENT DOCUMENTS

A-1-205180 8/1989 Japan .

A-4-303861 10/1992 Japan .

A-6-266206 9/1994 Japan .

*Primary Examiner*—Arthur T. Grimley

*Assistant Examiner*—Hoan Tran

*Attorney, Agent, or Firm*—Oliff & Berridge, PLC

[57] ABSTRACT

The present invention describes a charging device pressed against the surface of a body to be charged in a state of being applied with a voltage so as to charge the body. The charging device includes an electrically conductive support to which a voltage is to be applied; an electrically conductive elastic body layer fixed on the electrically conductive support; a resistance regulation layer covering the electrically conductive elastic body layer; and a protective layer laminated on the resistance regulation layer, having hardness of 6 H or more in pencil hardness, and made from a silicon compound.

6 Claims, 3 Drawing Sheets

CHARGING DEVICE

BACKGROUND OF THE INVENTION

The present invention relates to a charging device in an image forming apparatus such as an electrophotographic apparatus, an electrostatic recording apparatus, or the like, in an electrophotographic copying machine, a printer, a facsimile, composite OA appliances thereof, etc. More particularly, the present invention relates to a charging device which is pressed against a surface of a body to be charged such as a light-sensitive body, a dielectric body, or the like, to thereby charge the surface of the body to be charged uniformly.

In an image forming apparatus such as an electrophotographic apparatus, an electrostatic recording apparatus, or the like, such an operation is to charge a surface of a body to be charged such as a light-sensitive body, a dielectric body, or the like. As a charging means, there is generally used a contactless charging system in which charging is performed by corona discharge which is generated by application of a high voltage to a tungsten wire. In such a contactless charging system, however, a large amount of ozone or nitrogen oxide ($NO_x$) is generated to bring about environmental pollution in the periphery of the image forming apparatus. Further, there arises a problem that the surface of the light-sensitive body is denatured by a corona product to cause deterioration of the light-sensitive body or image fogging and that pollution of wire has an influence on image quality to cause white spotting or black streaking in image.

On the contrary to the aforementioned contactless charging system, there is a contact charging system in which charging is performed by bringing a charging device into contact with a body to be charged. The contact charging system has an advantage that the voltage to be applied to the charging device is low so that the quantity of generated ozone becomes very low.

The contact charging device also has a lot of problems to be solved and various proposals have been made. For example, in an electrically conductive rubber roller coated with a resin such as nylon, polyurethane, or the like, it is necessary to increase the quantity of electrically conductive particles contained in the electrically conductive rubber roller in order to keep low resistance. Therefore, rubber hardness increases, so that the surface of the body to be charged may be damaged because of the hardness of the rubber roller and by electrically conductive particles dispersed in the surface of the body to be charged. As a measure thereof, a charging device in which a surface layer formed from N-alkoxymethylated nylon is provided on an electrically conductive base layer formed from rubber or resin such as chloroprene rubber, or the like, has been proposed in the Unexamined Japanese Patent Application Publication No. Hei 1-205180.

Further, with the long-term operation of the image forming apparatus, the contact surface of the charging device begins to be contaminated gradually by deposition of toner, or the like, remaining on the body to be charged (light-sensitive body). As a measure thereof, a charging device in which a stratiform solid lubricant such as graphite, or the like, is impregnate in a surface layer to prevent toner, or the like, from being deposited on the surface has been proposed in the Unexamined Japanese Patent Application Publication No. Hei 4-303861. From the same reason, in order to prevent the light-sensitive body from being contaminated by the deposition of toner on the surface layer, a charging roller comprising an elastic layer having medium electric resistance, and a surface layer having high noncohesive characteristic and formed from a fluorine-containing cross-linked copolymer obtained by cross-linking fluorolefin-hydroxide group-containing vinyl ether with isocyanate has been proposed in the Unexamined Japanese Patent Application Publication No. Hei 6-266206.

In the charging device described in the Unexamined Japanese Patent Application Publication No. Hei 1-205180, however, the hardness of N-alkoxymethylated nylon is low so that the surface layer is damaged easily by the toner outer additive having high hardness slightly remaining on the body to be charged. Accordingly, image quality failure such as image density irregularity, or the like, occurs. In the charging device described in the Unexamined Japanese Patent Application Publication No. Hei 4-303861, a solid lubricant having a large particle size of 100 $\mu$m is present in the surface layer. Accordingly, unevenness of resistance is brought about, so that there occurs image quality failure caused by bias leaking or image density irregularity. Further, in the charging roller described in the Unexamined Japanese Patent Application Publication No. Hei 6-266206, the hardness of the fluorine-containing cross-linked copolymer is also low so that the surface layer is damaged easily. Accordingly, image quality failure such as image density irregularity, or the like, occurs.

On the other hand, in a contact charging device having a surface layer formed from a strong and noncohesive resin such as polyvinyl butyral, the stiffness of the surface layer is high so that uniform nipping with respect to the body to be charged cannot be made. There arises a problem that image density irregularity is caused by irregularity in charging.

Furthermore, in any one of the conventional contact type charging devices, toner and its outer additive, paper dust, or the like, are deposited on the surface of the charging device through the body to be charged when the charging device is used for a long term. There arises also a problem that the resistance value of the charging device is increased partially by the deposition of toner, or the like, on the body to be charged to thereby bring about lowering of charging characteristic.

SUMMARY OF THE INVENTION

Therefore, an object of the present invention is to provide a charging device which is to solve the aforementioned problems and make it difficult to deposit toner and its outer additive, paper dust, or the like, on the surface of the body to be charged to thereby prevent lowering of charging characteristic caused by the firm adhesion of the toner and which is excellent in durability so as to be free from image quality failure such as streaking, image density irregularity, or the like.

Another object of the present invention is to provide a charging device which has nip uniformity with respect to the body to be charged so that a good image can be obtained.

The inventors of the present invention have made researches earnestly and continuously on materials constituting the surface layer, hardness, etc. in order to prevent the lowering of charging characteristic of the charging device caused by contamination with toner, or the like, and the inventors have examined/discussed thoroughly the relation between the hardness of the surface layer in the charging device and the quantity of toner deposited on the surface layer. As a result, it has been found that the quantity of deposited toner decreases rapidly when the pencil hardness of the surface layer is in a range of from 5 H to 6 H and that toner is little deposited on the surface layer having such a high hardness uniform in long-term use. Thus, the present invention has been completed.

That is, the charging device according to the present invention is a charging device which is pressed against a surface of a body to be charged in a state where the charging device is applied with a voltage to thereby charge the body to be charged, wherein the charging device comprises: an electrically conductive support; an electrically conductive elastic body layer fixed on the electrically conductive support; a resistance regulation layer covering the electrically conductive elastic body layer; and a protective layer laminated on the resistance regulation layer and having hardness of 6 H or more in pencil hardness.

The present invention will be described below in detail.

As shown in FIG. 1, the charging device according to the present invention, when used as a charging roll, is constituted by an electrically conductive member in which: an electrically conductive elastic body layer 1*b* is fixed on an outer circumferential surface of a cylindrical or hollow-cylindrical electrically conductive support 1*a;* a surface of the elastic body layer 1*b* is entirely covered with a resistance regulation layer 1*c;* and a protective layer 1*d* is laminated on the resistance regulation layer 1*c*. A voltage is applied between the electrically conductive support 1*a* of the charging device 1 and a body to be charged (for example, a light-sensitive body 11 shown in FIG. 4).

The electrically conductive support which functions not only as an electrode of the charging device but also as a support member, is formed from an electrically conductive material, for example, a metal or an alloy such as aluminum, a copper alloy, stainless steel, or the like; iron plated with chrome, nickel, or the like; synthetic resin; and so on. The outer diameter of the electrically conductive support is generally set to a value in a range of from 4 mm to 12 mm.

The electrically conductive elastic body layer is provided to set the resistance and hardness of the charging device to predetermined values so that a surface of the body to be charged can be charged uniformly by pressing the charging device against the surface of the body to be charged with a suitable nip width or nip pressure. This elastic body layer is formed by dispersing electrically conductive particles in a rubber material.

Examples of the rubber material include isoprene rubber, chloroprene rubber, epichlorhydrine rubber, butyl rubber, urethane rubber, silicone rubber, fluoro rubber, SBR (styrene-butadience rubber), NBR (acrylonitrile-butadiene rubber), EPDM (ethylene-propylene-diene rubber), acrylonitrile-styrene-butadiene rubber, blended rubber thereof, and so on.

Above all, isoprene rubber, silicone rubber and EPDM are used preferably. These rubber materials may be foamed materials or may be unfoamed materials.

As the electrically conductive particles, there can be used fine powder of various kinds of electrically conductive metals or alloys such as carbon black, graphite, aluminum, stainless steel, etc., fine powder of various kinds of electrically conductive metal oxides such as tin oxide, zinc oxide, indium oxide, titanium oxide, tin oxide-antimony oxide solid solution, tin oxide-indium oxide solid solution, etc., and so on. When, for example, carbon black is used, 3 to 50% by weight of carbon black is arranged with respect to the rubber material in order to obtain a desired value of volume resistance.

The thickness of the electrically conductive elastic body layer is selected to be generally in a range of from 2 mm to 6 mm, preferably in a range of from 3 mm to 5 mm. The volume resistance value of the electrically conductive elastic body layer, which has close relevance to the volume resistance value of the resistance regulation layer which will be described later, is preferably selected to be in a range of from $10^2$ Ωcm to $10^5$ Ωcm.

The resistance regulation layer is provided to regulate the resistance value of the charging device to a predetermined value and is formed from a thin film obtained by dispersing the aforementioned electrically conductive particles in a resin.

The resin is not limited specifically, but it is preferable to use resins in a category of more or less soft materials such as polyurethane, polyamide, polyester, etc. When, for example, carbon black is used as a material for the electrically conductive particles, 10 to 30% by weight of carbon black is arranged with respect to the resin in order to obtain a desired volume resistance value.

The volume resistance value of the resistance regulation layer is preferably selected to be in a range of from $10^5$ Ωcm to $10^9$ Ωcm. The thickness of the resistance regulation layer is preferably selected to be in a range of from 5 μm to 50 μm, more preferably in a range of from 10 μm to 40 μm. If the thickness is smaller than 5 μm, not only it is impossible that the resistance regulation layer fulfills its function but also there is a risk that the surface of the body to be charged is damaged because of a tendency of occurrence of leaking. If the thickness is contrariwise larger than 50 μm, the resistance and hardness of the charging device increase to values larger than those required.

The protective layer functions as a surface layer for preventing the charging device from adhering closely or firmly to the surface of the body to be charged. Furthermore, in the present invention, the protective layer is provided to prevent the charging device from being contaminated by deposition or firm adhesion of toner and its outer additive, paper dust, or the like, remaining on the surface of the body to be charged to thereby prevent the lowering of charging characteristic and the occurrence of image quality failures caused by the lowering of charging characteristic. This protective layer is formed from a noncohesive silicon type compound shaped like a thin film.

Examples of the silicon type compound include silicon oxide (silica), silicon nitride, carborundum, organic group-substituted or nonsubstituted silicon oxide type/silicon nitride type ceramics, etc. Examples of the organic group include: hydrocarbon residual groups such as methyl group, ethyl group, n-propyl group, i-propyl group, n-butyl group, i-butyl group, t-butyl group, hexyl group, octyl group, decyl group, stearyl group, cyclopentyl group, cyclohexyl group, phenyl group, tolyl group, xylyl group, naphthyl group, benzyl group, phenethyl group, etc.; ether groups containing these hydrocarbon residual groups, such as alkoxy group, cycloalkoxy group, aryloxy group, etc.; thioether groups containing the aforementioned hydrocarbon residual groups; ester groups such as amino group, acetyloxy group, stearoyloxy group, benzoyloxy group, etc. obtained by substituting one or two of the aforementioned hydrocarbon residual groups; amide groups such as acetamide group, stearamide group, benzamide group, etc.; and so on.

The protective layer can be formed by vapor deposition of various kinds of inorganic silicon type compounds as described above.

Further, the protective layer formed from silicon type ceramics can be formed easily by coating the resistance regulation layer with a coating composition containing perhydrosilazane represented by the following chemical formula (in which n is a repetition factor) or containing polysilazane obtained by substituting the aforementioned organic group, and by heating or burning the resistance regulation layer at a temperature in a range of from 80° C. to 200° C. to decompose the aforementioned polysilazane thermally.

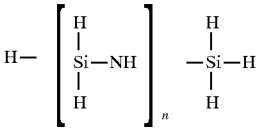

Examples of the method for applying the coating composition include a dip coating method, an air spraying method, a roll coating method, and so on. If the temperature for forming the protective layer is lower than 80° C., polysilazanes cannot be decomposed sufficiently so that desired silicon type ceramics cannot be generated. If the temperature is contrariwise higher than 200° C., the resistance regulation layer and the electrically conductive elastic body layer in the inside of the resistance regulation layer deteriorate. As the organic-group-substituted polysilazane, there can be used polysilazane obtained by substituting one or two organic groups with respect to one silicon atom. In this case, there is no special disadvantage even if the organic group has relevance to thermal decomposing reaction under a high heating temperature, for example, of 200° C.

When perhydropolysilazane is heated under an air or oxygen gas atmosphere, silicon oxide type ceramics are produced in the aforementioned thermal decomposing reaction. When perhydropolysilazane is heated under a nitrogen gas atmosphere, silicon nitride type ceramics are produced in the aforementioned thermal decomposing reaction. When organic-group-substituted polysilazane is used, silicon type ceramics denatured by the organic group are produced so that both the hardness of the charging device and the hardness of the protective layer can be reduced. Polysilazane in which the percentage of substitution of the organic group is not larger than 30% is used generally, but the present invention is not limited thereto.

Incidentally, crystalline silicon type compounds generally have the property of being hard and fragile. On the contrary, according to the thermal decomposing method, noncohesive amorphous silicon type ceramics having flexibility are produced in any case so that they have preferable characteristic as surface protecting layers.

The thermal decomposed product of polysilazanes is substantially formed from the aforementioned silicon type ceramics. More specifically, the silicon type ceramics generally contain either or both of hydrogen atoms and nitrogen atoms in an amount of the order of several tenths % or smaller.

Accordingly, when, for example, perhydropolysilazane per se is decomposed thermally, the protective layer is not always formed from a pure silicon oxide or nitride film.

The film thickness of the protective layer is preferably in a range of from 0.1 μm to 3.5 μm. If the film thickness is smaller than 0.1 μm, there is a risk that the function of the protective layer cannot be fulfilled because the protective layer is inferior in durability such as abrasion resistance, or the like. If the film thickness is contrariwise larger than 3.5 μm, the protective layer has a tendency of occurrence of cracks in the case of an inorganic silicon type compound having no organic group substituted, and irregularity of charging occurs in that case. Particularly when the film thickness is in a range of from 0.3 μm to 3.0 μm, the aforementioned disadvantage does not occur.

In the present invention, the protective layer has hardness of 6 H or more in pencil hardness, and the protective layer having such hardness can be formed easily by the aforementioned vapor deposition method or thermal decomposing method.

Incidentally, the protective layer is formed from a very thin film, so that the hardness thereof cannot be measured with the commonly used JIS A hardness or Ascar C. Therefore, in the present invention, the hardness is expressed in pencil hardness in accordance with the measuring method according to JIS K5400. With respect to this measuring method, there is more or less difference in operation between a test machine method and a hand lacing method. The hand lacing method will be described in brief. Here, the pencil hardness is assumed so that the density symbol 9 H is hardest and the density symbol 6 B is softest, and the harder is made a higher rank.

While a pencil having a flat end and a sharp angle is pressed against a surface of a test piece (a stainless steel plate having a coating film as a sample) at an angle of 45° as intensively as possible so that the lead is not broken, the pencil is extruded ahead of a test person by about 1 cm at a uniform speed of about 1 cm/sec to thereby scrape the coating film surface. After the test piece is shifted so as to change the position, the aforementioned operation is repeated five times. In the five-times tests, a pair of pencils which have values of hardness adjacent to each other and in which the coating film is broken or scratched not less than twice and less than twice respectively are obtained and the density symbol of the lower-rank pencil in which the coating film is broken or scratched less than twice is regarded as a pencil hardness.

The hardness of the charging device is selected to be not higher than 70°, preferably in a range of from 40° to 68° in Ascar C. If the hardness is higher than 70°, the nip uniformity between the charging device and the body to be charged is spoiled so that not only image quality failure occurs but also, for example, the surface of the light-sensitive body is abraded gradually in long-term use. The lower the aforementioned hardness is, the more preferable it is. A limit point in production of the charging device is, however, 30° in Ascar C so long as the electrically conductive elastic body layer does not contain a large amount of softener or plasticizer.

The volume resistance of the charging device is preferably in a range of from $10^5$ Ωcm to $10^{10}$ Ωcm. This volume resistance value can be regulated easily within the aforementioned range by suitably adjusting the aforementioned volume resistance of the electrically conductive elastic body layer, and the aforementioned volume resistance and film thickness of the resistance regulation layer. If the volume resistance is smaller than $10^5$ Ωcm, an overcurrent flows in the surface of the body to be charged so that leaking occurs frequently when a pinhole is present in the surface of the body to be charged. If the volume resistance is contrariwise larger than $10^{10}$ Ωcm, it is difficult to charge the body to be charged at a low voltage so that image quality failure occurs because of shortage of charging quantity.

On the other hand, DC and AC superimposed voltages are preferably applied between the charging device and the body to be charged so that the DC voltage is in a range of from 200 V to 1500 V and the peak-to-peak AC voltage (Vp-p) is in a range of from 1 kV to 4 kV.

For example, the charging device according to the present invention is produced as follows.

First, a rubber material, electrically conductive particles and suitably added compounding agents such as a softener, a cross-linking agent (inclusive of a vulcanizer and a vulcanization accelerator), an electrically non-conductive filler, etc. are kneaded sufficiently by an open roll, a kneader, or the like, to thereby prepare a rubber composition for forming an elastic body layer.

Then, the aforementioned rubber composition is molded by an extrusion molding method, an injection molding method, or the like, and packed in a mold in which the electrically conductive support 1*a* is supported in the center. Although there is some variation depending on the kind of the rubber material and the kind of the compounding agent, the rubber composition is heated at a temperature of from 100° C. to 180° C. for a time of from 10 to 90 minutes, parted from the mold and heated at a temperature of from 150° C. to 230° C. to perform secondary vulcanization. Then, the surface of the electrically conductive elastic body layer 1*b* firmly adhering to the outer circumference of the support 1*a* is polished if necessary.

When the electrically conductive elastic body layer 1*b* is formed from a foamed material, a foaming agent is mixed in the aforementioned rubber composition or an inert gas is mixed in the aforementioned rubber composition by a gas mixing method in advance so that a foamed elastic body layer 1*b* can be formed by a press molding method. Examples of the foaming agent include: azo type compounds such as azodicarbonamide, α,α'-azobisisobutyronitrile, diazoaminobenzene, etc.; sulfohydrazide type compounds such as benzene sulfonylhydrazide, p-toluene sulfonylhydrazide, etc.; nitroso type compounds such as dinitrosopentamethylene tetramine, etc.; and so on. As the inert gas, nitrogen gas, carbon dioxide gas, or the like, is used.

Then, a resin component, electrically conductive particles and additives to be suitably blended are added to an organic solvent and mixed sufficiently to thereby prepare a coating composition for forming a resistance regulation layer. Then, the aforementioned coating composition is applied onto the surface of the aforementioned electrically conductive elastic body layer 1*b* by a suitable coating method such as a dip coating method, an air spraying method, or the like, and then dried at the ordinary temperature or dried while heated to thereby form a resistance regulation layer 1*c*. Further, a protective layer 1*d* is formed on the resistance regulation layer 1*c* by the aforementioned vapor deposition method, the thermal decomposing method, or the like to thereby prepare a charging device 1 according to the present invention.

Although the roll-shaped charging device (charging roll) has been described above, the charging device according to the present invention may be shaped like a block or a blade. With respect to the direction of the thickness as shown in FIG. 2, in the block-shaped or blade-shaped charging device, an electrically conductive elastic body layer 2*b* or 3*b* is stuck/fixed to a plate-like electrically conductive support 2*a* or 3*a* in a side opposite to a body to be charged on which a charging device 2 or 3 is disposed under pressure, and a resistance regulation layer 2*c* or 3*c* and a protective layer 2*d* or 3*d* are laminated on the elastic body layer 2*b* or 3*b* successively.

Such a charging device is produced, for example, as follows. A rubber material in the aforementioned rubber composition is cross-linked and the resulting electrically conductive elastic body is cut into a desired size to thereby form an electrically conductive elastic body layer. After an electrically conductive support is then entirely stuck onto a surface of the elastic body layer, the aforementioned coating composition for forming a resistance regulation layer is preferably applied onto surfaces other than the adhesive layer and dried to thereby form a resistance regulation layer. Further, a protective layer is formed on the resistance regulation layer.

The charging device according to the present invention can be applied not only to the charger but also to a copying machine, a destaticizer, or the like. When used as a charging device in a copying machine, the charging device is pressed against a body to be charged such as a light-sensitive body, or the like, through a transfer material such as a sheet, or the like, and the volume resistance value of the charging device is adjusted to be within a range of from $10^7$ Ωcm to $10^{10}$ Ωcm. When used as a charging device in a destaticizer, the charging device directly touches a body to be charged, and the volume resistance value of the charging device is adjusted in a range of from $10^2$ Ωcm to $10^4$ Ωcm.

Heretofore, it has been said that a very small quantity of toner and its outer additive, paper dust, etc. which remain after cleaning can hardly deposit on a charging device having a surface layer formed from a fluororesin or a silicone resin small in surface energy and excellent in mold-parting characteristic.

Incidentally, the outer additive contains a small quantity of an anti-filming agent as another component than the main component such as silica, etc. Cerium oxide is generally used as the anti-filming agent. Cerium oxide is, however, a matter having a very high hardness as commonly used as an abrasive material. If the charging device is used in a long term, cerium oxide eats a relatively soft surface layer of a fluororesin, or the like. Accordingly, the charging device is gradually contaminated with toner, or the like, remaining on the body to be charged through a cleaning blade. This fact has been made clear by the inventors of the present invention simultaneously and in parallel in the process in which the aforementioned relation between the hardness of the surface layer and the quantity of deposited toner has been examined.

On the basis of such findings, the charging devices 1 to 3 according to the present invention is designed so that the hardness of a protective layer laminated on the surface of the charging device is not lower than 6 H as pencil hardness. That is, the aforementioned contamination of the charging device is observed in a protective layer having a pencil hardness lower than 6 H. In the present invention, the hardness of the protective layer is, however, high so that there is no lowering of charging characteristic in a long term. Accordingly, because there is no occurrence of image quality failure such as streaking, image density irregularity, or the like, the charging device is particularly excellent in the durability thereof. Furthermore, because the protective layer is formed from a noncohesive non-rubber or non-resin material, the charging device is prevented from closely adhering to the surface of the body to be charged even in the case where an image forming apparatus is operated in a long term.

Further, when the film thickness of the protective layer formed in the surface of the charging device is in a range of from 0.1 μm to 3.5 μm, the protective layer is soft regardless of its high hardness, very good in nip tracking with respect to the body to be charged and excellent in nip uniformity. Accordingly, the surface of the body to be charged is charged uniformly so that a good image can be obtained.

BRIEF DESCRIPTION OF THE DRAWINGS

FIG. 1A is a perspective view thereof, and FIG. 1B is a sectional view thereof.

FIGS. 2A and 2B are sectional views of different charging devices respectively.

DETAILED DESCRIPTION OF THE PREFERRED EMBODIMENTS

The present invention will be described below specifically on the basis of embodiments thereof, but the invention is not limited to the following embodiments.

(Image Forming Apparatus)

Figure 1A:
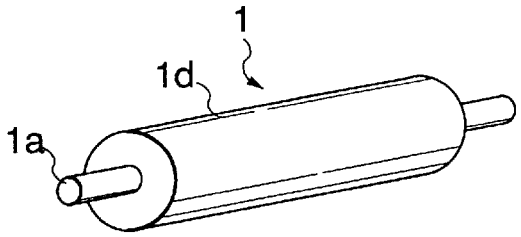
FIGS. 1A and 1B are views for explaining a charging device as an embodiment of the present invention.
Figure 1B:
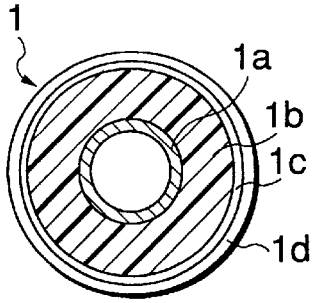
Figure 2A:
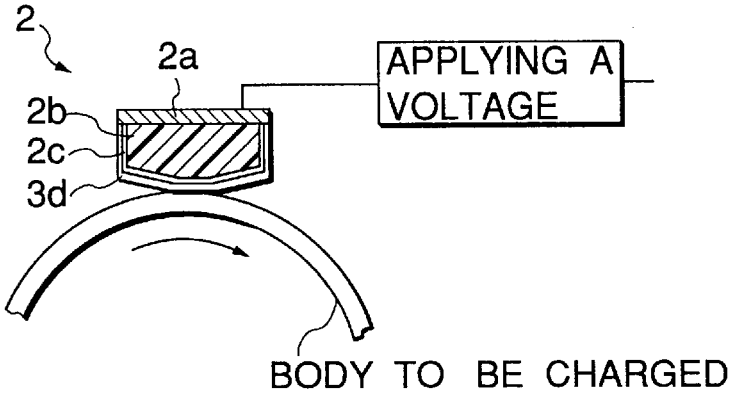
FIGS. 2A and 2B are views for explaining the charging device as another embodiment of the present invention.
Figure 2B:
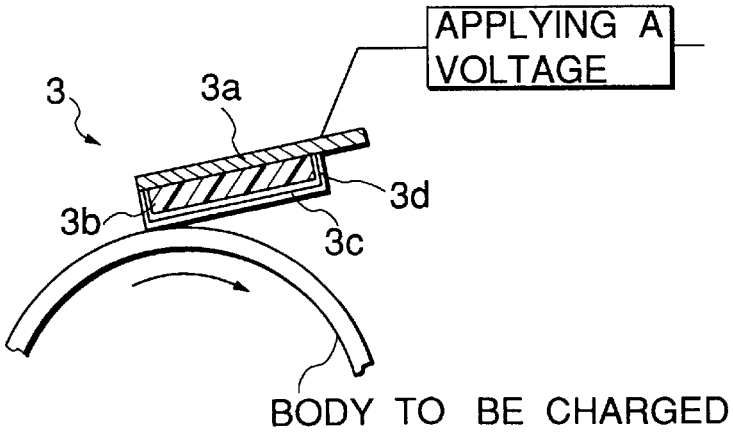
Figure 3:
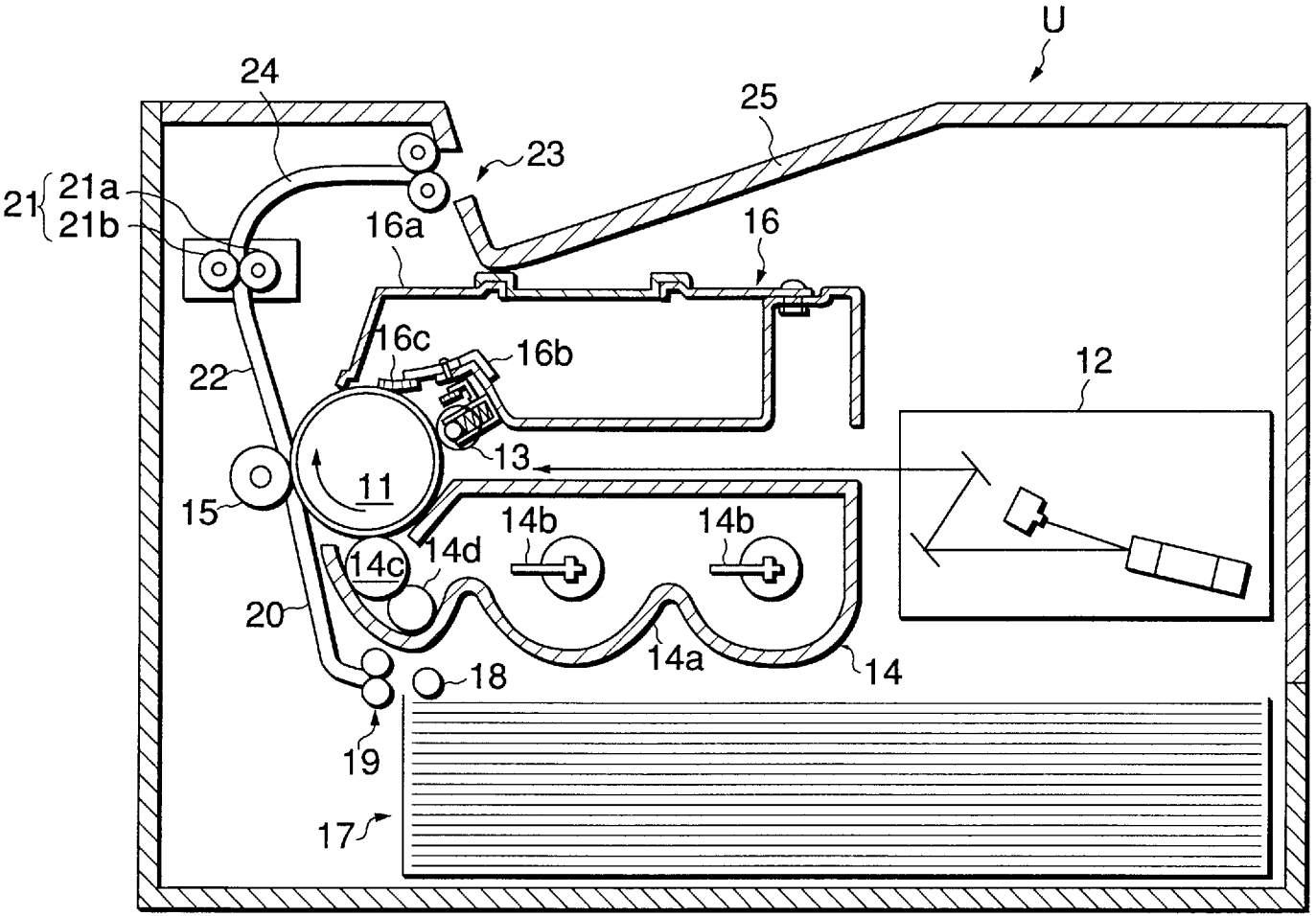
FIG. 3 is a view for explaining the whole of an image forming apparatus including the charging device according to the present invention.

FIG. 3 is a view for explaining the whole of an image forming apparatus containing a roll-shaped charging device according to the present invention as shown in FIG. 1, and a vertical sectional view taken in the left and right directions in the center portion.

In FIG. 3, a cylindrical light-sensitive body (drum) 11 rotating in the direction of the arrow is disposed in the inside of a body of the image forming apparatus U so as to serve as an electrostatic latent image carrier. A laser writer 12 for writing an electrostatic latent image in the surface of the light-sensitive body 11 is disposed in one side of the inside of the body of the image forming apparatus U. A charger 13 for charging a surface of the light-sensitive body 11 uniformly, a developer 14 for developing the aforementioned electrostatic latent image, a transfer machine 15 for transferring the developed toner image to a sheet of paper (transfer material) and a cleaner 16 for removing remaining toner on the light-sensitive body 11 are disposed successively along the direction of the rotation of the cylindrical light-sensitive body 11 in the periphery of the cylindrical light-sensitive body 11.

The developer 14 has a vessel 14*a* for receiving toner. Stirring members 14*b*, 14*b* for stirring toner, a rotatable developing agent carrier 14*c* and a toner supply roller 14*d* for supplying toner to the carrier 14*c* are provided in the inside of the vessel 14*a*. The developing agent carrier 14*c* faces to an opening portion of the vessel 14*a* and is supported by the vessel 14*a* through a slight gap between the developing agent carrier 14*c* and the surface of the light-sensitive body 11. The aforementioned cleaner 16 has a casing 16*a*. A metal blade holder 16*b* is fixed to this casing 16*a*, and a sheet-like cleaning blade 16*c* is firmly stuck to an end portion of the blade holder 16*b*. An edge portion which is an end portion of the cleaning blade 16*c* abuts on the surface of the light-sensitive body 11.

A paper supply tray 17 for receiving paper is disposed in the lower portion of the body of the image forming apparatus U. A paper takeout roller 18 for taking out sheets of paper one by one from the paper supply tray 17 is disposed in an end portion of the upper surface of the paper supply tray 17. A pair of paper guides 20 for guiding a sheet of paper to be carried by a pair of paper carrying rollers 19 are disposed in the side upper portion of the paper takeout roller 18.

A fixer 21 having a heating roller 21*a* and a pressing roller 21*b* is disposed in the upper portion of the opposite side portion in the inside of the body of the image forming apparatus U. A carry path 22 for carrying the sheet of paper having a toner image transferred is disposed between the fixer 21 and the transferrer 15. Further, a pair of exhaust rollers 23 and a carry path 24 for guiding the sheet of paper having the fixed toner image from the fixer 21 to the exhaust rollers 23 are provided above the fixer 21. Further, an exhaust tray 25 on which paper discharged from the exhaust rollers 23 is put, is formed in the upper surface of the body of the image forming apparatus U.

(Charger)

Figure 4:
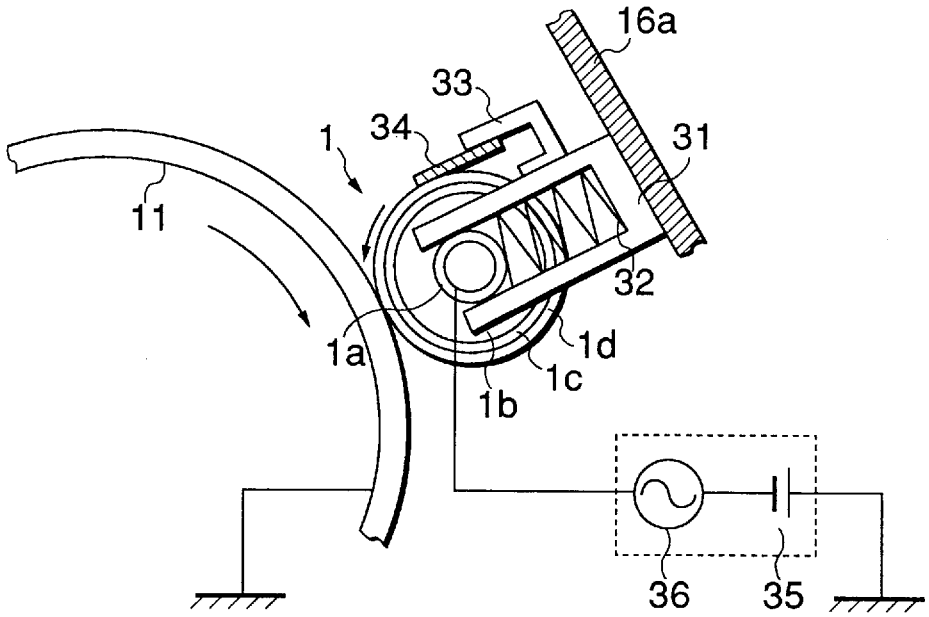
FIG. 4 is an enlarged view of main part of FIG. 3 showing the structure of a charger.

FIG. 4 is an enlarged view of main part of FIG. 3 showing the structure of the aforementioned charger.

In FIG. 4, the charger 13 has a roll-shaped charging device 1 as described above. The charging device 1 is designed so that opposite end portions of the electrically conductive support 1*a* thereof are supported by a support member 31 fixed to the casing 16*a* of the cleaner 16. Further, the charging device 1 is pressed against a surface of a light-sensitive body 11 so as to be brought into contact with the light-sensitive body 11 by the urging force of two pressing springs 32 each having one end fixed to the support member 31 and an opposite end fixed to an end portion of the support 1*a*. A pad holder 33 of a metal is fixed to the support member 31 so that even in the case where a very small quantity of toner is deposited on the surface of the charging device 1, the toner is removed by a sheet-like cleaning pad 34 firmly fixed to an end portion of the pad holder 33.

Further, superimposed vibration voltages from a DC electric source 35 and an AC electric source 36 connected in series are applied to the support 1*a* of the charging device 1. Accordingly, the charging device 1 can perform charging of the surface of the light-sensitive body 11 uniformly rotating in a predetermined direction while touching the surface protective layer 1*d* by the electrically conductive elastic body layer 1*b* and the resistance regulation layer 1*c* through the support 1*a*.

The operation of the image forming apparatus U in the present invention is the same as that of the conventional apparatus and the brief description thereof is as follows.

As described above, the surface of the light-sensitive body 11 rotating in the direction of the arrow is charged uniformly by the charging device 1 to which superimposed vibration voltages are applied. An electrostatic latent image is written into the thus uniformly charged light-sensitive body 11 by the laser writer 12. The electrostatic latent image on the light-sensitive body 11 is developed to a toner image by the developer 14. The toner image is transferred to a sheet of paper carried from the paper supply tray 17 by the transferrer 15. After the transferred toner image is fixed by the fixer 21, the sheet of paper is discharged onto the exhaust tray 25 by the exhaust rollers 23. Further, after the toner image is transferred to the sheet of paper, toner remaining on the surface of the light-sensitive body 11 is removed by the blade 16*c* of the cleaner in order to make a preparation for the next electrophotographic process.

(Embodiment 1)

Foaming agent-containing electrically conductive silicone rubber (DY32-5048U: made by Toray—Dow Corning K.K.) was kneaded sufficiently by an open roll. Then, in a mold having an inner diameter of 16 mm in which an SUS (stainless steel) support 1*a* having an outer diameter of 8 mm was supported so as to be in the center, the aforementioned kneaded matter was molded by an extrusion method and heated at 180° C. for one hour to foam the silicone rubber. Further, the foamed matter was secondarily vulcanized at 200° C. for four hours so that a roll-shaped electrically conductive elastic body layer 1*b* having a thickness of 4 mm was formed on the outer circumference of the support 1*a*.

Then, the following components were mixed in a ball mill to thereby prepare a dispersion in which carbon black was uniformly dispersed in a resin solution. The thus prepared dispersion was applied onto the aforementioned elastic body layer 1*b* by spraying, heated and dried to thereby form a resistance regulation layer 1*c* having a film thickness of 20 μm and formed from a polyurethane film.

Single liquid type urethane resin 100 parts by weight
(XH-407: DAINIPPON INK & CHEMICALS, INC.)

Carbon black 5 parts by weight
(Regal 660R: made by Cabot)

2-butanone 100 parts by weight

Further, a roll having a resistance regulation layer 1*c* formed thereon was immersed in a 20% xylene solution of perhydropolysilazane (Tonen Polysilazane; made Tonen Corp.) having a weight-averaged molecular weight of 4000 to 5000, and then burned at 150° C. to thereby form a protective layer 1*d* formed from an amorphous silica film and having a film thickness of 1 μm. The hardness of the roll-shaped charging device 1 thus produced was measured. As a result, the hardness was 51° in Ascar C, and the pencil hardness of the amorphous silica film was 9 H.

(Embodiment 2)

Tin oxide was added to a resin solution obtained by stirring polyamide resin and methanol. The components were mixed in a ball mill to thereby prepare a dispersion containing the following components.

Polyamide resin 100 parts by weight
(CM8000: made by Toray Industries Inc.)

Fine powder-like tin oxide 600 parts by weight
(Pastran: made by Mitsui Mining & Smelting Co., Ltd.)

Methanol 300 parts by weight

The dispersion thus obtained was applied onto the foamed elastic body layer 1*b* formed in Embodiment 1 by spraying, heated and dried to thereby form a resistance regulation layer 1*c* formed from a tin oxide-containing polyamide resin and having a film thickness of 30 μm. Further, the roll was immersed for coating and burned in the same manner as in Embodiment 1 to thereby form a protective layer 1*d* formed from an amorphous silica film and having a film thickness of 3 μm. The hardness of the roll-shaped charging device 1 thus produced was 65° in Ascar C, and the pencil hardness of the amorphous silica film was 9 H.

(Embodiment 3)

The roll of Embodiment 1 having the resistance regulation layer 1*c* formed was immersed in a 20% xylene solution of perhydropolysilazane. Then, the roll was burned in a nitrogen current at 150° C. to thereby form a protective layer 1*d* formed from an amorphous silicon nitride film and having a film thickness of 0.5 μm. The hardness of the roll-shaped charging device 1 thus produced was 55° in Ascar C, and the pencil hardness of the amorphous silicon nitride film was 9 H.

(Embodiment 4)

The roll of Embodiment 1 having the resistance regulation layer 1*c* formed was immersed in a 20% xylene solution of 10%-methylated perhydropolysilazane (Tonen polysilazane: made by Tonen Inc.). Then, the roll was burned at 150° C. to thereby form a protective layer 1*d* formed from a methyl group-denatured amorphous silica film and having a film thickness of 1 μm. The hardness of the roll-shaped charging device 1 thus produced was 45° in Ascar C, and the pencil hardness of the methyl group-denatured amorphous silica film was 6 H.

(Embodiment 5)

The roll of Embodiment 1 having the resistance regulation layer 1*c* formed was immersed in a 20% xylene solution of 10%-phenylated perhydropolysilazane (Tonen polysilazane: made by Toner Inc.). Then, the roll was burned at 150° C. to thereby form a protective layer 1*d* formed from a phenyl group-denatured amorphous silica film and having a film thickness of 2 μm. The hardness of the roll-shaped charging device 1 thus produced was 45° in Ascar C, and the pencil hardness of the amorphous silica film was 6 H.

(Embodiment 6)

A roll-shaped charging device 1 was produced in the same manner as in Embodiment 1 except that the thickness of the protective layer 1*d* was 4 μm. The hardness of the charging device 1 thus produced was 60° in Ascar C, and the pencil hardness of the amorphous silica film was 9 H.

(Comparative Example 1)

An elastic body layer 1*b* formed from an electrically conductive foamed silicone rubber and a resistance regulation layer 1*c* formed from a polyurethane film were formed on the outer circumference of a support 1*a* in the same manner as in Embodiment 1. The hardness of the roll-shaped charging device 1 thus produced was 40° in Ascar C, and the pencil hardness of the carbon black-containing polyurethane film was 3 B.

(Comparative Example 2)

An elastic body layer 1*b* formed from an electrically conductive foamed silicone rubber and a resistance regulation layer 1*c* formed from a polyamide resin film were formed on the outer circumference of a support 1*a* in the same manner as in Embodiment 2. The hardness of the roll-shaped charging device 1 thus produced was 50° in Ascar C, and the pencil hardness of the tin oxide-containing polyamide resin film was 2 B.

(Comparative Example 3)

The roll of Embodiment 1 having a resistance regulation layer 1*c* formed was immersed in a resin solution of diethyleneglycolbisallyl carbonate and then heated to thereby form a protective layer 1*d* formed from the aforementioned carbonate resin film and having a film thickness of 1 μm. The hardness of the roll-shaped charging device 1 thus produced was 45° in Ascar C, and the pencil hardness of the carbonate resin film was 5 H.

(Image Evaluation Test)

The roll-shaped charging device produced as described above was attached to a charger 13 in a copying machine (Vivace 500: made by Fuji Xerox Co., Ltd.).

Superimposed vibration voltages from a DC electric source 35 and an AC electric source 36 connected in series were applied to the support 1*a* of the charging device so that a surface of the light-sensitive body 11 having an outer diameter of 30 mm and brought into contact with the charging device 1 was charged to −420 V uniformly. The aforementioned superimposed vibration voltage was composed of a DC component of −420 V, and an AC component having a peak-to-peak voltage of 2 kV. Further, in a process after charging, an image was formed on a sheet of paper according to the ordinary method.

The aforementioned copying machine was operated to be subjected to a printing durability test. In Embodiments 1 to 5, a sharp image was obtained, that is, there is no deterioration of image quality caused by contamination of the charging device even after 200,000 copies were taken. In Embodiment 6, however, innumerable cracks occurred in the protective layer, that is, irregularity of image quality occurred after 10,000 copies were taken.

On the contrary, in Comparative Examples 1 to 3, irregularity of image density was observed, that is, the toner outer additive firmly adhered to the surface of the charging device after 500 copies, 1,000 copies and 30,000 copies were taken respectively.

In the charging device according to the present invention, because the hardness of the surface protective layer is 6 H or higher as pencil hardness, there is no occurrence of contamination of the charging device with toner, or the like. Accordingly, there is no lowering of charging characteristic in a long term. Accordingly, because there is no occurrence of image quality failure such as streaking, image density irregularity, or the like, the charging device is excellent in durability.

Furthermore, the charging device in which the film thickness of the protective layer is in a range of from 0.1 μm to 3.5 μm, is excellent in nip uniformity with respect to a body to be charged. Accordingly, the body to be charged can be charged uniformly, so that a good image is obtained.

What is claimed is:

1. A charging device pressed against a surface of a body to be charged in a state of being applied with a voltage so as to charge said body, comprising:

an electrically conductive support to which a voltage is to be applied;

an electrically conductive elastic body layer fixed on said electrically conductive support;

a resistance regulation layer covering said electrically conductive elastic body layer; and a protective layer laminated on said resistance regulation layer, having hardness of 6 H or more in pencil hardness and made from a silicon compound.

2. The charging device of claim 1, wherein the thickness of said protective layer is in a range of from 0.1 μm to 3.5 μm.

3. The charging device of claim 1, wherein said silicon compound is a silicon oxide ceramic.

4. The charging device of claim 1, wherein said silicon compound is a silicon nitride ceramic.

5. The charging device of claim 3, wherein said silicon ceramic is a thermally decomposed product obtained by heating polysilazanes at a temperature in a range of from 80° C. to 200° C.

6. The charging device of claim 4, wherein said silicon ceramic is a thermally decomposed product obtained by heating polysilazanes at a temperature in a range of from 80° C. to 200° C.

* * * * *